US006057768A

United States Patent [19]

Barnoach

[11] Patent Number: 6,057,768

[45] Date of Patent: May 2, 2000

[54] SLEEP PREVENTION DEVICE FOR DRIVER

[76] Inventor: Izhak Barnoach, Ahl Dakar 4, Uerzliya 46702, Israel

[21] Appl. No.: 09/126,083

[22] Filed: Jul. 30, 1998

[51] Int. Cl.[7] ..... G08B 23/00

[52] U.S. Cl. ..... 340/575; 340/407.1; 340/576

[58] Field of Search ..... 340/573.1, 573.7, 340/575, 576, 439, 472, 407.1; 128/848, 846

[56] References Cited

U.S. PATENT DOCUMENTS

| | | | |
|---|---|---|---|
| 4,272,764 | 6/1981 | Herr et al. | 340/575 |
| 4,617,525 | 10/1986 | Lloyd | 340/573.1 |
| 4,713,890 | 12/1987 | Wells et al. | 33/366 |
| 4,938,476 | 7/1990 | Brunelle et al. | 482/148 |
| 5,341,127 | 8/1994 | Smith | 340/407.1 |
| 5,373,859 | 12/1994 | Forney | 128/846 |
| 5,381,801 | 1/1995 | McShane et al. | 128/848 |
| 5,522,092 | 6/1996 | Streb et al. | 340/575 |
| 5,568,127 | 10/1996 | Bang | 340/575 |
| 5,581,239 | 12/1996 | Lin | 340/575 |
| 5,684,460 | 11/1997 | Scanlon | 340/573.1 |
| 5,684,461 | 11/1997 | Jones | 340/575 |

*Primary Examiner*—Jeffery A. Hofsass
*Assistant Examiner*—Van T. Trieu
*Attorney, Agent, or Firm*—Foley & Lardner

[57] ABSTRACT

This invention relates to an apparatus for preventing a driver from falling asleep. The apparatus comprises a gravity actuated sensor and a vibrator, which are placed within a housing. The apparatus is placed on the drivers head. It can be attached to a hat which is worn by the driver. The gravity activated sensor senses when it is in a predetermined range of deviation from the horizontal, and sends a detect signal which activates a vibrator which irritates the driver, and prevents him from falling asleep.

1 Claim, 6 Drawing Sheets

SLEEP PREVENTION DEVICE FOR DRIVER

FIELD OF THE INVENTION

The invention relates to an apparatus for preventing a driver from falling asleep.

BACKGROUND OF THE INVENTION

There are many devices for preventing a driver from falling asleep. Some of the devices monitor the driver's head position, and send an alert when the driver's head is tilted forward. For example, U.S. Pat. No. 5,684,461 describes a sleep prevention device for a driver of a vehicle. The device is comprised of a head set, a mercury switch, an alarm indicator having a speaker for emitting a vocal alarm, a volume control dial, a light emitting diode, a 12 volt adapter and a flexible pouch. The head set is placed on the head of the driver, and the mercury switch is within a housing that is attached to the headset. The mercury switch senses when the driver's head is tilted forward and thereupon sends an activation signal. A mercury switch has a sealed glass housing. In one end of the housing there are two electrodes. The first electrode is placed at a short distance from the second electrode. Within the housing there is a small amount of mercury. When the driver's head is in a predetermined range of deviation from the horizontal, the mercury moves into contact with the two electrodes and closes an electrical circuit across the electrodes. The activation signal activates the speaker, which emits a vocal alarm. A disadvantage of this device is its complexity and its use of many separate parts. Another disadvantage of this device is the use of a vocal alarm to notify the driver that he is falling asleep. Sending a vocal alarm is not efficient when the driver is in a noisy environment, or when the driver activates a radio, a C.D. player, a tape player or any other apparatus which produces sound and/or noise. A further disadvantage of this device is the need to connect it to an external power supply source.

There is a need for an improved apparatus for preventing a driver from falling asleep, of compact size. There is a need for an improved apparatus for preventing a driver from falling asleep, which is effective even when driver is in a noisy environment, or when the driver activates a radio, a C.D. player, a tape player or any other apparatus which produces sound and/or noise.

SUMMARY OF THE INVENTION

The underlying problem of the invention is basically solved by applying the features laid down in the independent claims. Preferred embodiments are given in the dependent claims.

An advantage of the invention is that it provides a compact apparatus for preventing a driver from falling asleep. Another advantage of the invention is that it provides an apparatus for preventing a driver from falling asleep, which is effective even when the driver is in a noisy environment. A further advantage of the invention is that it has an independent power supply, and there is no need to attach external wires or cables to the device.

DETAILED DESCRIPTION

Figure 1:
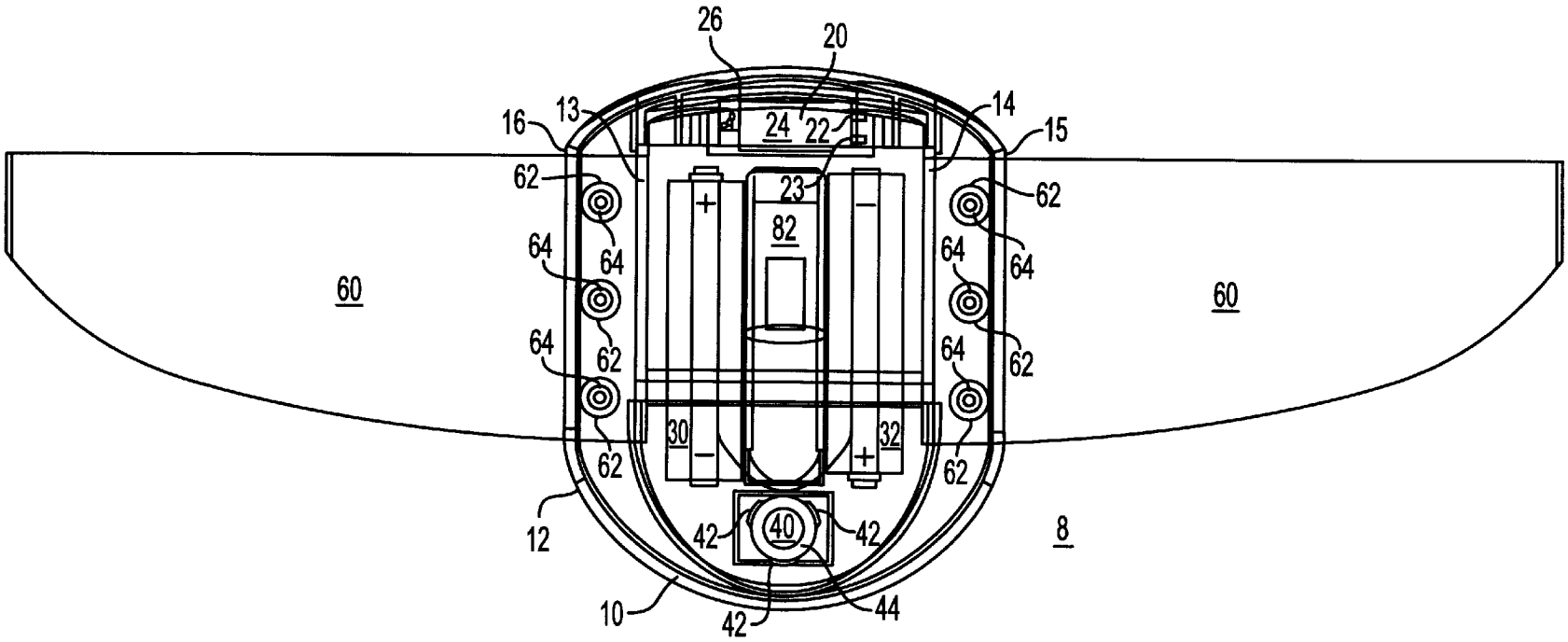
FIG. 1 is a top sectional view of an apparatus for preventing a driver from falling asleep, according to a preferred embodiment of the invention.
Figure 2:
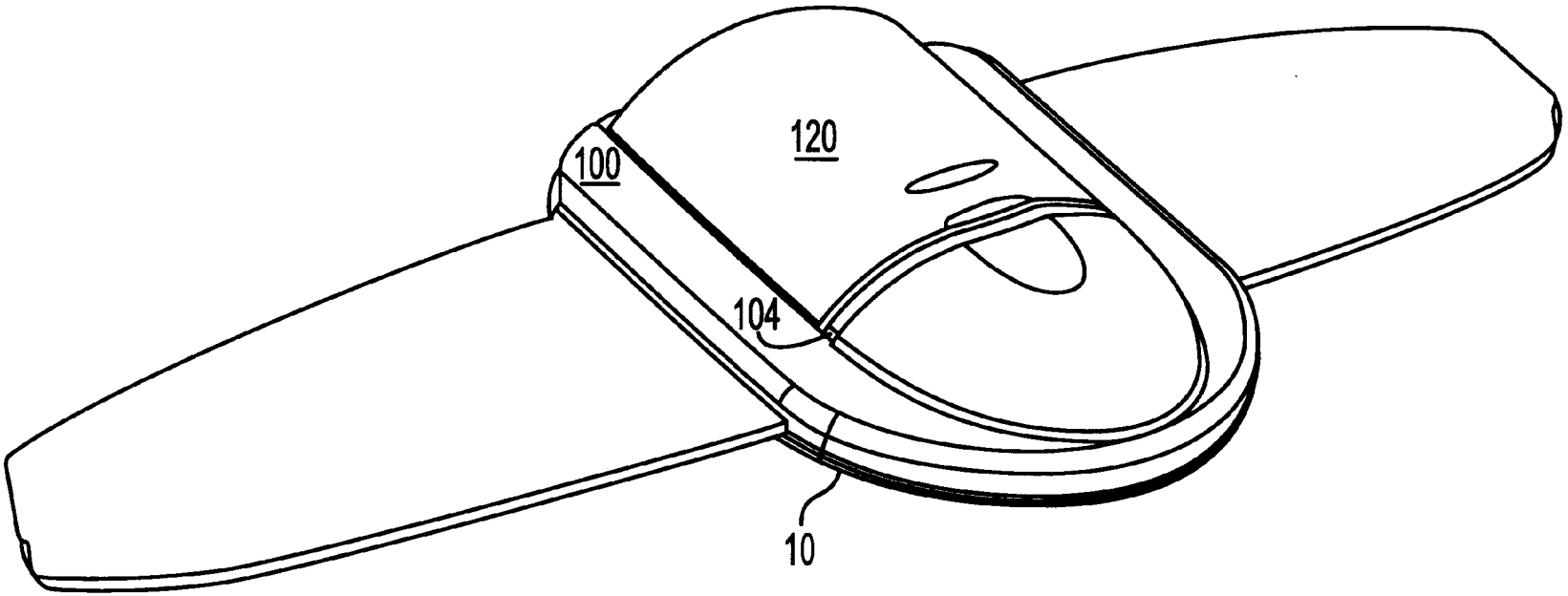
FIG. 2 is an exploded view of the housing of the apparatus for preventing a driver from falling asleep, according to a preferred embodiment of the invention.
Figure 3:
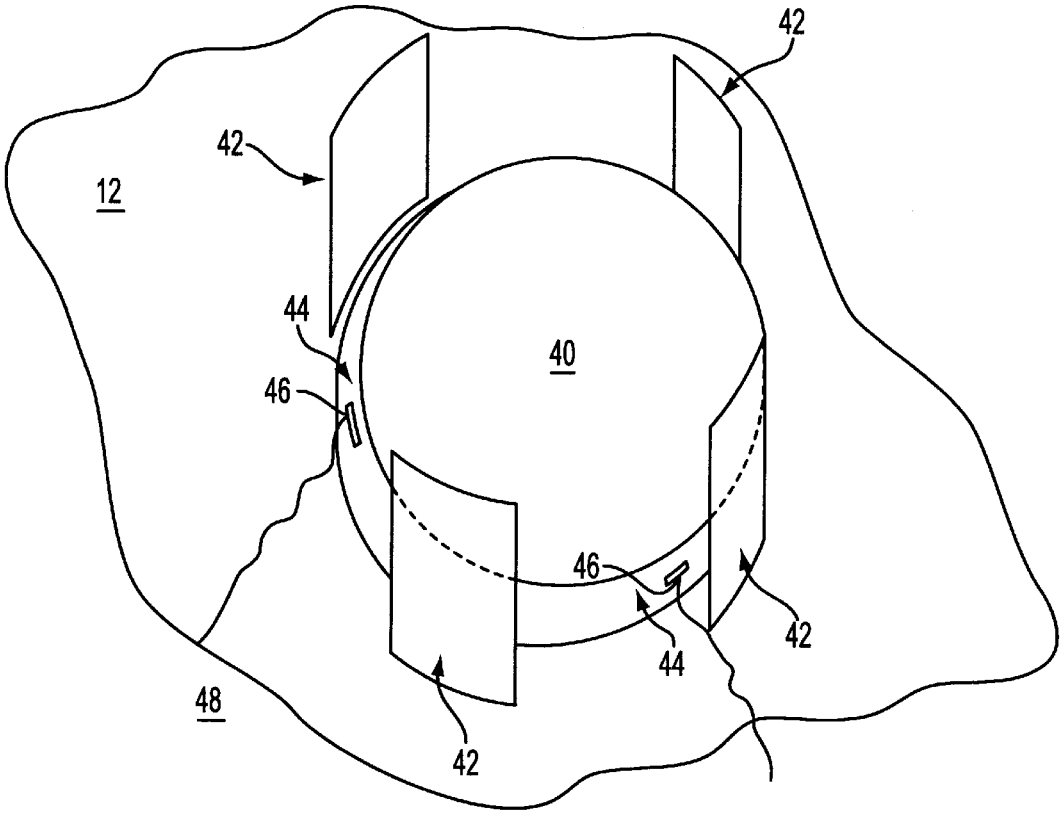
FIG. 3 is a perspective view of the gravity actuated sensor of the apparatus for preventing a driver from falling asleep, according to a preferred embodiment of the invention.

Referring to FIG. 1, a preferred embodiment of the invention, comprises a housing 10, having a lower part 12 and an upper part 100 (shown in FIGS. 2,3). Lower part 12 has two vertical limiters 13 and 14, two slots 15 and 16, for receiving a belt 60, a recess 44 (not shown in FIG. 1) and a plurality of vertical pins 64. Vibrator 20, has inputs 22 and 23, and a motor 24 having shaft 26 (shown in FIG. 5) connected to asymmetrical load 28. Batteries are labeled 30 and 32. A conductive object, preferably shaped as a ball (i.e.—conductive ball) 40 is retained by a plurality of limiters 42. Belt 60 has a plurality of holes 62 for attaching the belt ends to the housing. An electrical circuit 82 comprises a detect signal driver 131 and a vibrator driver (all shown in FIG. 4 or FIG. 5).

Belt 60 is used to attach the apparatus 8 to the apparatus user. Belt 60 is preferably made of a flexible material. Belt 60 is described only for convenience of explanation and there can be a variety of attachment means for attaching the apparatus 8 to its user. For example, apparatus 8 can be placed in a pocket on the front side of its user's shirt. Belt 60 has a plurality of holes 62, which fit the pins 64 of the lower part of the housing 12.

The vertical limiters 13 and 14 of lower part 12 of housing 10 are used to support the power supply means, preferably batteries 30 and 32.

Batteries 30 and 32 are coupled to electrical circuit 80, for energizing electrical circuit 82 and vibrator 20.

Vibrator 20 has inputs 22 and 23, coupled to vibrator driver 181, for receiving D.C. voltage. When there is sufficient voltage differential between inputs 22 and 23, motor 24 is activated. Motor 24 drives an asymmetrical load 28, and produces vibrations. Load 28 can also be made of an eccentrically balanced wheel. Conveniently, motor 24 is relatively small and revolves at low frequency, so that the vibrations irritate the user of apparatus 8, thus preventing him from falling asleep.

Conductive ball 40, limiters 42 and recess 44 form a gravity actuated sensor 48 (shown in FIG. 4) for sensing when apparatus 8 is in a predetermined range of deviation from the horizontal. Apparatus 8 is attached to its user so that this deviation occurs when its user sleeps in a predetermined posture, preferably on his back. Conductive ball 40 can freely move in a space defined by recess 44, limiters 42 and upper part 100 of housing 10. Recess 44 is formed in lower part 12 of housing 10. Limiters 42 surround recess 44, and preferably are perpendicular to lower part 12 of housing 10. The distance between two consecutive limiters is smaller than the diameter of conductive ball 40, and is preferably less than the radius of conductive ball 40. Limiters 42 are made of non conductive material. Conveniently, recess 44 is shaped according to the shape of conductive ball 40, so that conductive ball 40 will remain in recess 44 as long as the user of apparatus 8 is in a predetermined range of deviation from the horizontal. When the user's head is outside of that range, conductive ball 40 exits recess 44. Preferably, the recess 44 is of circular shape and is slightly bigger than the conductive ball 40. Preferably, the depth of recess 44 equals one half of the radius of the conductive ball 40. The predetermined range of deviation mentioned above can be changed by changing the shape of recess 44, and/or conductive ball 40, or by changing the position of apparatus 8 in relation to its user. Those who are skilled in the art will appreciate that conductive ball 40, and accordingly recess 44, can have different shapes. Those who are skilled in the art will appreciate that if the space defined by recess 44, limiters 42 and upper part 100 of housing 10, is sealed, conductive ball 40 can be replaced by a conductive fluid.

At least two electrodes 46 are placed within recess 44, wherein as long as conductive ball 40 is in the recess, it closes an electrical circuit across electrodes 46. As explained in further detail in FIG. 4, the closing of an electrical circuit generates a detect signal.

Those who are skilled in the art will appreciate that gravity actuated sensor 48 can be implemented in various ways. For example, and without limiting the scope of the invention, gravity actuated sensor 48 can be implemented by a mercury switch. The mercury switch has a sealed and non conductive housing. In one end of the housing there are two electrodes. The first electrode is placed at a short distance from the second electrode. Within the housing there is a small amount of mercury. When the user of apparatus 8 is in a predetermined range of deviation from the horizontal, the mercury moves into contact with the two electrodes and closes an electrical circuit across the electrodes.

As a further example, and without limiting the scope of the invention, gravity actuated sensor 48 can be implemented by two conductive parts. The first part is a free swinging pendulum. The second part is a conductive plate or ring which is placed near the free swinging pendulum, in a manner that it will make contact with the free swinging pendulum, when the pendulum swings out of a predetermined vertical amount. This predetermined vertical amount reflects the predetermined range of deviation from the vertical of the user's head.

FIG. 2 is a perspective view of housing 10 of apparatus 8 for preventing a driver from falling asleep, according to a preferred embodiment of the invention. Housing 10 has an upper part 100, a lower part 12 and a battery cover 120. Battery cover 120 is connected to a conductive plate 127 (not shown in FIG. 2). Two rails 104 are connected to upper part 100. Rails 104 are parallel to each other and perpendicular to upper part 102 of the housing 10. Battery cover 120 can move along rails 104. Preferably, battery cover 120 has three positions: "ON" in which the conductive plate 127 connects batteries 30 and 32 to electrical circuitry 82, "OFF", in which conductive plate 127 disconnects batteries 30 and 32 from electrical circuitry 82, and a third position in which battery cover 120 is removed from housing 10, allowing the replacement of batteries 30 and 32.

Housing 10 is relatively slim, compact and it is convenient to wear.

Housing 10 is described for convenience of explanation only and any housing, having an ON/OFF switch and a hatch for replacing batteries 30 and 32 can be implemented.

FIG. 3 is a perspective view of the gravity actuated sensor of the apparatus for preventing a driver from falling asleep, according to a preferred embodiment of the invention. The gravity actuated sensor is formed of the conductive ball 40, the limiters 42, the recess 44 and the electrodes 46.

Figure 4:
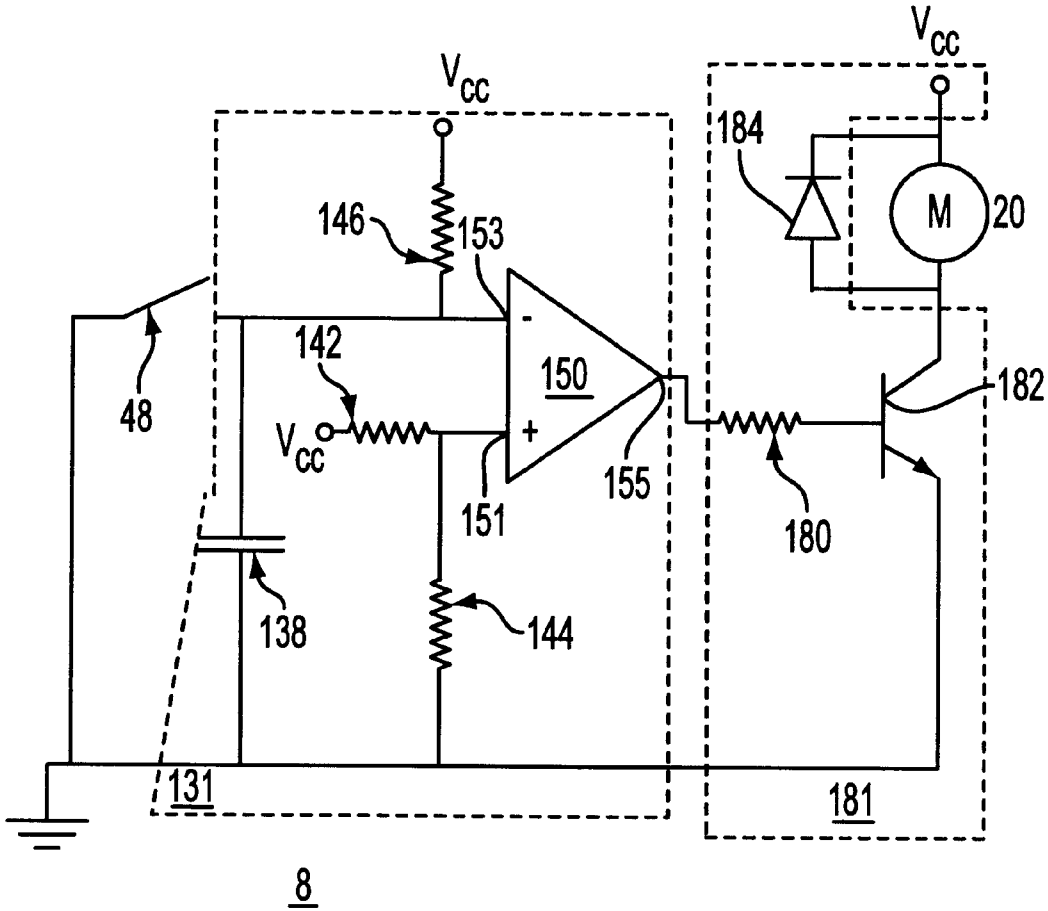
FIG. 4 is an electrical schematic description of the apparatus for preventing a driver from falling asleep, according to a preferred embodiment of the invention.

FIG. 4 is a schematic description of the apparatus 8 for preventing a driver from falling asleep, according to a preferred embodiment of the invention, comprising: gravity actuated sensor 48, detect signal driver 131 and vibrator driver 181. Each of these parts can be implemented by various ways, and just for convenience of explanation one embodiment is described in further detail. The detect signal driver 131 is not essential, and the gravity actuated sensor 48 can be coupled directly to the vibrator driver 181.

Gravity actuated sensor 48 comprises recess 44, limiters 42 and upper side 100 of housing 10 (not shown in FIG. 4), a conductive ball 40 and at least first and second electrodes 46' and 46". More than two electrodes can be used.

Detect signal driver 131, for smoothing the detect signal, comprises first capacitor 138, first resistor 142 and a second resistor forming a first resistive voltage divider, a pull-up resistor 146 and a first comparator 150, having positive input 151, a negative input 153 and output 155.

Vibrator driver 181 comprises a bias resistor 180, a transistor 182, a diode 184 and inputs 22 and 23 of vibrator 20.

The voltage supply described in FIG. 4 is the batteries 30 and 32 (not shown in FIG. 4), which are connected or disconnected to the electrical circuit 82 by the battery cover 120 (not shown in FIG. 4). Batteries 30 and 32 can be coupled to a voltage measurement means (shown in FIG. 5), for measuring the voltage level supplied by batteries 30 and 32, and sending an alert signal when the batteries are going to expire. For example, and without limiting the scope of the invention, the voltage measurement means can be coupled to a plurality of light emitting diodes (i.e.—LED's) which can indicate the voltage level.

First electrode 46' is coupled to the ground and the second electrode is coupled to the negative input 153 of the first comparator 150, and to one end of the pull-up resistor 146. The other end of the pull-up resistor is coupled to the power supply. One end of the first resistor 142 of the first resistive voltage divider 140 is coupled to the power supply and the other end is coupled to the positive input of the first comparator. One end of the second resistor 142 of the first resistive voltage divider 140 is coupled to the ground and the other end is coupled to the positive input 151 of the first comparator 150. The output of the first comparator 155 is coupled to one end of the bias resistor 180. The other end of the bias resistor 180 is coupled to the base of the transistor 182. The collector of the transistor 182 is coupled to the first input 22 of the vibrator 20. The power supply is coupled to the second input 23 of the vibrator 20. The cathode of diode 184 is coupled to the power supply and the anode of the diode 184 is coupled to the collector of transistor 182.

When the conductive ball does not close an electrical circuit between the electrodes 46' and 46, the pull up resistor 146 charges the first capacitor 138 until the voltage level arriving to the negative input 153 of the first comparator equals the power supply voltage. The first resistive voltage divider 140 divides the power supply voltage and inputs a reference voltage, which is lower than the power supply voltage, to the positive input 151 of the first comparator 150. Because the voltage level input to the positive input 151 of the first comparator 150 is lower than the voltage level input to the negative input 153 of the first comparator 150, the output level of the first comparator 150 is low. The low level of the output of the first comparator causes the transistor 182 to be in a cut off state. When the transistor 182 is in cut-off there is almost no voltage differential between inputs 23 and 22 of vibrator 20, so that the vibrator is not activated.

When the conductive ball closes the electrical circuit between the electrodes, it generates a detect signal by pulling the negative input 153 of the first comparator 150 to ground and drives the output of the first comparator output 155 to be high. This high signal forces the transistor 182 to saturate, creates a voltage differential between the two inputs 22 and 23 of the vibrator 20, and activates the vibrator 20.

Figure 5:
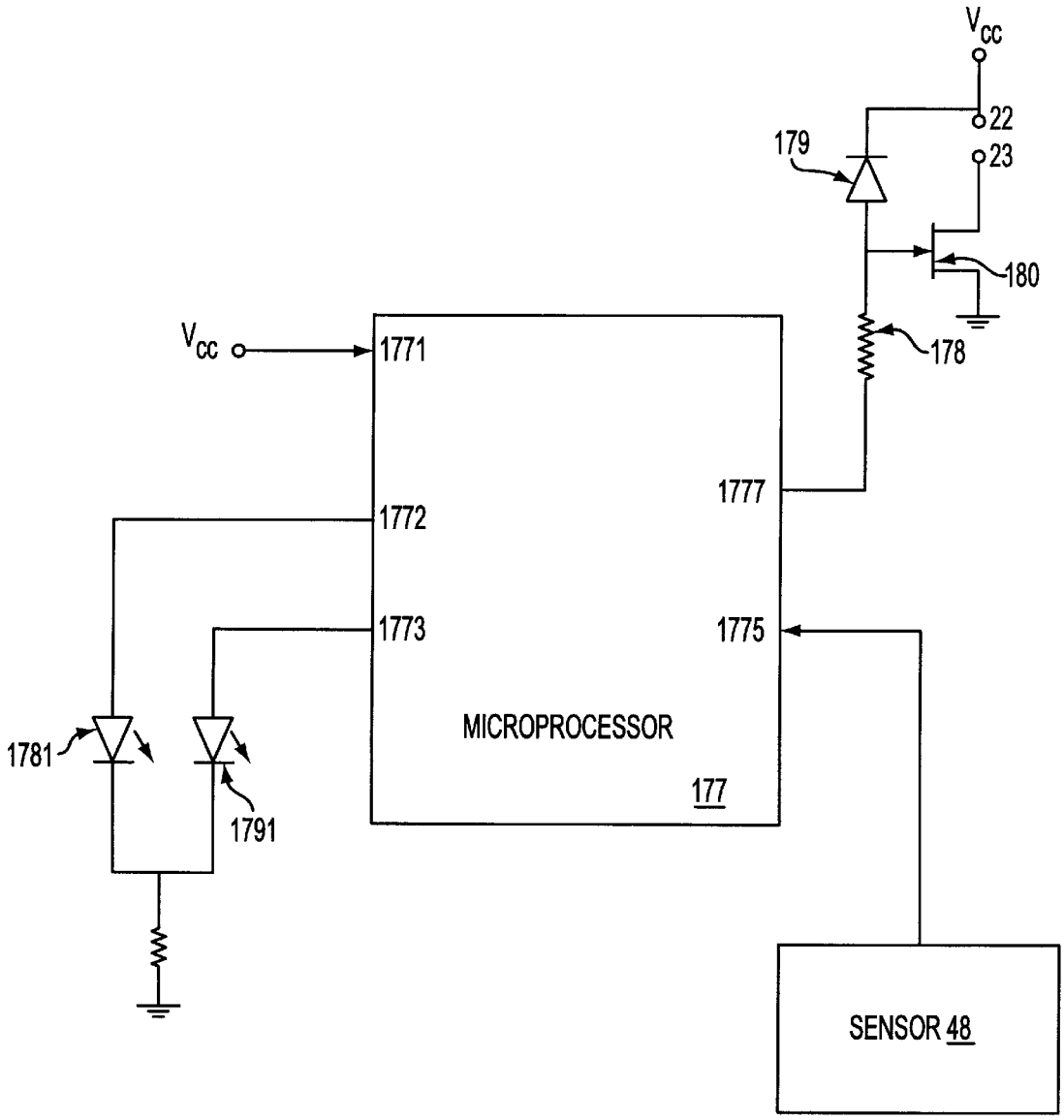
FIG. 5 is an electrical schematic description of the apparatus for preventing a driver from falling asleep, according to another preferred embodiment of the invention.

FIG. 5 is an electrical schematic description of the apparatus for preventing a driver from falling asleep, according to another preferred embodiment of the invention. Microprocessor 177, has vcc input 1771, for receiving supply voltage; vibrator output 1777 and sensor input 1775 for receiving detect signals from sensor 48. Microprocessor 177 can also have a plurality of LED outputs 1772 and 1773, for driving a plurality of LED's 1781 and 1791. LED's 1781 and 1791 are used to indicate the level of voltage supplied by batteries 30 and 32. Microprocessor 177 can perform the functions of detect signal driver 131 and time delay circuit 161, shown in FIG. 4. Microprocessor 177 can have an internal memory for storing a series of instruction which operate microprocessor 177.

Figure 6:
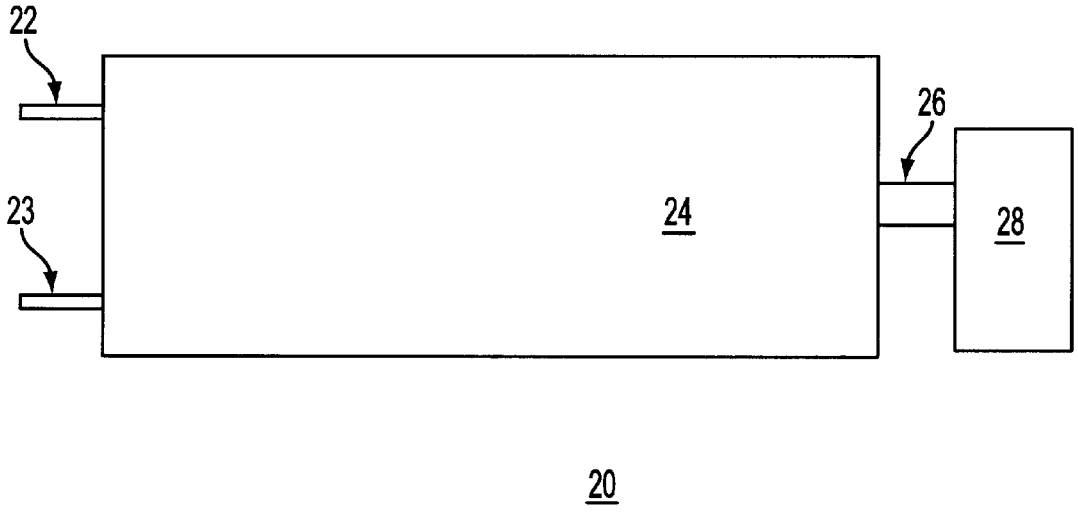
FIG. 6 is a top plan view of the vibrator of the apparatus for preventing a driver from falling asleep, according to a preferred embodiment of the invention.

Vibrator output 1777 is coupled to resistor 178, diode 179 and power-transistor 180 for driving vibrator 20 (Shown in FIG. 6).

FIG. 6 is a top plan view of the vibrator 20 of the apparatus for preventing a driver from falling asleep, according to a preferred embodiment of the invention. Vibrator 20 has inputs 22 and 23, a motor 24 having shaft 26 and an asymmetrical load 28 on shaft 26.

Those who are skilled in the art will appreciate that various changes in form and detail can be made without departing from the spirit and scope of the invention which is determined in the claims that follow.

I claim:

1. An apparatus for preventing a driver from falling asleep, comprising:

a housing;

a gravity actuated sensor, placed within the housing, for sensing when the driver's head is tilted, and sending a detect signal;

a vibrator, placed within the housing, for producing low frequency vibrations which irritate the driver and prevent the driver from falling asleep;

a vibrator driver, placed within the housing and coupled to the vibrator and to the gravity actuated sensor, for activating the vibrator after receiving a detect signal;

a power supply means, placed within the housing, coupled to the gravity actuated sensor and to the vibrator driver;

a detect signal driver connected between the gravity actuated sensor and the vibrator for smoothing the detect signal;

wherein the apparatus has at least two electrodes, wherein the gravity actuated sensor closes an electrical circuit across the electrodes when it senses that the apparatus is in a predetermined range of deviation from the horizontal;

wherein the detect signal driver comprises: a first capacitor, a first resistor, a second resistor, a pull-up resistor and a first comparator, having positive input, a negative input and output; wherein the first and second resistor form a first resistive voltage divider;

wherein the vibrator driver comprises: a bias resistor, a transistor, a diode and a plurality of outputs coupled to the vibrator inputs;

wherein a first electrode is coupled to the ground and a second electrode is coupled to the negative input of the first comparator, and to one end of the pull-up resistor; wherein the other end of the pull-up resistor is coupled to the power supply;

wherein one end of the first resistor is coupled to the power supply and the other end is coupled to the positive input of the first comparator; wherein one end of the second resistor is coupled to the ground and the other end is coupled to the positive input of the first comparator;

wherein the output of the first comparator is coupled to one end of the bias resistor and the other end of the bias resistor is coupled to the base of the transistor; wherein the collector of the transistor is coupled to the first input of the vibrator; and wherein the power supply is coupled to the second input of the vibrator; wherein the cathode of the diode is coupled to the power supply and the anode of the diode is coupled to the collector of the transistor.

* * * * *